US006116498A

United States Patent [19]

Sheffer

[11] Patent Number: 6,116,498

[45] Date of Patent: Sep. 12, 2000

[54] STACKABLE OPEN-TOP CONTAINER

[75] Inventor: Phil B. Sheffer, Thomasville, Pa.

[73] Assignee: Pack N'Stack, Inc., Philadelphia, Pa.

[21] Appl. No.: 09/334,396

[22] Filed: Jun. 16, 1999

[51] Int. Cl.[7] ..... B65D 5/22

[52] U.S. Cl. ..... 229/114; 229/167; 229/169; 229/172; 229/915

[58] Field of Search ..... 229/114, 167, 229/169, 172, 178, 915

[56] References Cited

U.S. PATENT DOCUMENTS

| | | | |
|---|---|---|---|
| 2,588,455 | 3/1952 | Adams | 229/915 |
| 3,580,475 | 5/1971 | Mobley | 229/915 |
| 3,910,484 | 10/1975 | Wozniacki | 299/178 |
| 3,934,790 | 1/1976 | Easter | 229/915 |
| 3,935,990 | 2/1976 | Crane . | |
| 4,119,265 | 10/1978 | Dlugopolski . | |
| 4,537,344 | 8/1985 | Thomas . | |
| 4,720,013 | 1/1988 | Nichols et al. | 206/506 |
| 4,919,267 | 4/1990 | Stoll | 206/507 |
| 5,125,568 | 6/1992 | Bauer | 229/172 |
| 5,535,942 | 7/1996 | Vilona | 229/199 |

FOREIGN PATENT DOCUMENTS

| | | | |
|---|---|---|---|
| 1145090 | 3/1963 | Germany | 229/915 |
| 1295281 | 11/1972 | United Kingdom | 229/178 |

*Primary Examiner*—Gary E. Elkins
*Attorney, Agent, or Firm*—Duane, Morris & Heckscher, LLP

[57] ABSTRACT

An open-top fold-and-glue container is provided a collapsed or knocked-down-flat configuration and can be erected into a nested stacking frusto-pyramidal configuration in which the container walls are inclined outwardly and an upper container is supported on self-erecting shoulders in a lower container in the stack. The container has a bottom integral with opposite end walls and side walls, the end and side walls each being formed of an inner panel folded downwardly against an outer panel. The shoulders are located in the inner panels of the end walls, and are self-erecting in the manner of an expanding parallelogram between upper and lower glue strips and a support strip projecting substantially vertically downwardly from the shoulder to the bottom. The attachment of the upper glue strip to the outer panel of the end wall forms a reinforcement at the rim. The ledge is disposed adjacent to and under this reinforcement, and a manual grip can be placed immediately under the ledge. The end and side walls are structurally attached to one another at each corner of the container, by means of a wing or a bellows fold that extends laterally from the outer panel of the end wall at each corner. The wing or bellows fold is captured between the inner and outer panels of the adjacent side wall. The container is particularly apt for carrying lightweight bulky but crushable items such as bakery rolls, loaves and similar products. Such products can be transported and handled in large stacks of nested containers, extending a substantial vertical distance and including many nested containers that contain product covered by the next higher container(s) and protected from vertical crushing forces.

18 Claims, 13 Drawing Sheets

STACKABLE OPEN-TOP CONTAINER

BACKGROUND OF THE INVENTION

1. Field of the Invention

The invention relates to paperboard, corrugated craft and similar cartons and containers made from an integral one piece blank, having contiguous panels that are preliminarily folded and glued such that the carton, container, or tray is manufactured and can be supplied in a knocked-down flat configuration, and is erected into a rectilinear three dimensional form prior to loading with a product or similar contents. In particular the invention concerns a container as described, which is structured as an open-top container or tray, that nests part-way into other similar containers when stacked.

2. Prior Art

Corrugated and paperboard cartons, containers, and trays are cut in required shapes from pieces of flat stock, which usually are folded, and are assembled to form the walls and bottom of a receptacle. Variations are possible in which several integral parts are formed and then assembled using glue, tape, staples or the like. For example, various types of inserts may be used for reinforcement or other purposes such as subdividing the volume of the container into discrete areas or for reinforcing the walls against crushing or displacement.

For convenience in this disclosure, a rectilinear container can be considered to have two pairs of side walls at right angles. The side walls extend perpendicularly upward from a bottom, the opposite side walls being spaced and parallel to one another in opposite pairs. The respective side walls define a front, a back and two opposite end walls, all of which are vertical. A top and bottom are spaced from one another and are horizontal, extending from the upper and lower edges of the side walls. The top is sometimes omitted, or top flaps may be folded inwardly against the inner surface of the sidewalls. The top also may be formed by a separate integral lid member. It will be appreciated that designations such as "top," "bottom," "side" and "end" are used for convenience to distinguish relative positions. Such a container could be in any orientation and could have a "lid" portion which was placed at the position of a side wall or bottom, and otherwise be substantially the same as a more conventional arrangement.

Containers are supplied in a collapsed or knocked-down-flat (KDF) state because storage or handling of empty containers is wasteful of space. KDF containers are partly formed, namely with the necessary parts cut out and preliminarily assembled at certain seams and folds between panels that will form side and end walls, a top and a bottom. Some containers are made without a given wall such as the top, and if they are to be closed off a separately integral lid is provided. The packer erects the container body into a three dimensional shape prior to loading, and in the process finishes the assembly steps that remain. For example, a container may have a number of contiguously adjacent panels cut out from an integral sheet of flat stock, scored and folded at corners between side and end wall panels and between the side and/or end panels and the top and bottom panels, sometimes called flaps. The panels defining the side and end walls can be folded and attached via at least one seam, with the panels knocked-down-flat into a collapsed parallelogram. The container is supplied with the opposite side and end walls collapsed flat against one another. The packer erects the container from a flat configuration into its open-top rectilinear shape, folding the top and bottom flaps perpendicularly inwardly and affixing the flaps to one another and/or to the side or end wall panels.

It is efficient to provide a form of container in which all the container parts are integral extensions of a single piece of flat material, but this also places some constraints on possible structures. Separate parts such as partitions and reinforcing inserts normally involve disadvantageous manual assembly steps that are costly and consume worker time. Assembly steps can be physically taxing for a worker that erects one container after another, and may lead to repetitive motion injuries. Thus it is preferable if containers are as fully formed as possible when they are supplied, nevertheless being knocked-down-flat. It is further preferable if the containers can be made fully erect and functional using the least possible and/or quickest and easiest of manual actions to deploy, load, store, pack and ship the containers.

Self-erecting paperboard and corrugated open-top cartons, containers, and trays are known with their respective walls connected in such a way that one or more of the structural parts of the container is pulled into an erected position as the other parts are erected. For this purpose, bellows folds or gussets can attach adjacent side and end wall panels. The bellows folds are glued on one of two diagonally-attached bellows panels to one of the side or end wall. The other of the side and end wall is folded inward in the KDF configuration. When either of the side and end walls is later pulled into an orientation perpendicular to the bottom (vertical), the bellows folds pull the other of the side and end walls into a perpendicular orientation as well, thus erecting the container.

Containers are routinely stacked vertically to make efficient use of space, and may be reinforced against vertical crushing by employing multiple thicknesses of material for wall panels or by forming columns, for example as in U.S. Pat. No. 5,330,094—Merz. Known structures that are reinforced in this manner are constructed using separate inserts or using a container structure that requires various manual operations to configure and install or erect the reinforcing structure.

Two or more containers are often stacked. Stacked containers are readily carried manually, and are stacked in a storage area or on a pallet or the like to form a compact arrangement for storage or shipping. The stack can have any number of adjacent containers. The individual containers normally can be either in vertical registry or in a staggered overlapping arrangement resembling masonry. Stacking maximizes density for storage, and often enables a group of containers to be handled conveniently as a discrete unit, e.g., using a fork-lift truck or two wheel hand dolly.

Open-top containers can also be stacked. However the containers need to be aligned or structurally arranged such that the vertical walls of the lower container support the upper container. For example, the containers can have side walls with a wide ledge formed at the top to admit a lateral misalignment up to the width of the ledge.

Containers in stacks may be subjected to various vertical and lateral forces. Vertical compression force is applied against lower containers by the weight of upper containers and the product they contain. This vertical force is borne by vertically elongated structural elements in the underlying cartons such as vertical front, back and/or end walls. The structural elements that bear vertical forces on an open-top carton or similar container normally occupy only a limited span of lateral width and/or depth. For example, the vertical forces on many open-top cartons are borne exclusively by their vertical side and end walls. If the stacked open-top cartons remain in registry, then the weight of each upper container is coupled, by the side and end walls of the upper container, to corresponding side and end walls of an underlying container. This is because the side and/or end walls of the upper and lower containers are disposed directly over and under one another.

The present invention provides a site-erected open-top container or carton that is entirely formed from an integral flat blank. The only assembly required is erection from a knocked-down-flat configuration, accomplished by lifting the end walls to perpendicular relative to the back and folding inwardly the flap extensions of the front and back walls to capture extensions of the end walls. The end and side walls taper outwardly relative to vertical when erected, the container forming the inverted frustum of a four sided pyramid (i.e., wider at the top and narrower at the bottom). The end walls have a ledge portion that extends inwardly from an elevation spaced downward from the container rim at the end panel, namely by a glued strip or reinforcing rail. The ledge portion is the top of a self erecting ledge panel that opens from a flattened parallelogram when the end wall is erected to vertical. This structure allows for the nesting of a plurality of containers in a vertical stack, the bottoms of the upper containers being received in the open tops of the lower containers down to the height of the ledge portion.

The container is supplied with substantially all its joints pre-attached, preferably by gluing. The container can be produced automatically in a KDF configuration using a fold-and-glue container production machine, for example as available from Bobst Group, Inc., 146 Harrison Avenue, Roseland, N.J. 07068 (affiliated with Bobst, SA, Lausanne, CH). At the loading site the user need only fold the various wall panels into place, fill the container to produce a stackable unit that is readily handled, stacked on a pallet, or otherwise processed for storage or shipment.

SUMMARY OF THE INVENTION

It is an object of the invention to structure a fold-and-glue knocked-down-flat open-top container blank so as to improve both its vertical stacking strength when erected and the ease of nesting when vertically stacked, and in so doing to eliminate the need for careful registry of the containers by manual action during stacking.

It is another object to provide hollow vertical reinforcing ledge structures at the end walls of a tapering open-top container which is erectable from a folded flat configuration, these reinforcing structures extending inwardly and defining an extent to which the containers can nest.

It is also an object to provide such reinforcing ledge structures immediately adjacent to a glued reinforcing rail at the upper edge of the container, preferably also providing a hand grip opening under the reinforcing ledge structures such that the ledge, reinforcing rail and hand grip are intimately connected for manually engaging and supporting one container or a number of containers in a stack.

It is a further object to provide a wide shallow tray meeting the foregoing objects, the tray being dimensioned and arranged aptly for storing relatively bulky and crushable products such as loaves of bread and similar bakery products, fragile products such as fruit and produce, and the like. Yet a further object is to facilitate stacking of such tray containers, by minimizing the weight attributable to the containers in the stack, as opposed to their contents, thus enabling numerous vertically stacked and nested of containers to be handled as a structural unit for deliveries, returns for refilling, etc.

These and other objects are provided in one embodiment of the invention by an open-top container that is made in a collapsed configuration, the container when erected having a bottom, spaced outwardly-tapered end walls and side walls, and hollow internal shoulders located on an inner side of the end walls adjacent to an upper rim. Each end wall includes an exterior panel and an interior panel that are joined to one another along a common transverse fold.

The exterior panel is joined to the bottom along a common transverse fold, and includes two wings that are joined, one each, to the longitudinal side edges of the exterior panel along a common longitudinal fold. The wings can be captured between folded-inward panels of the adjacent front and back walls, and can be a simple extension of a two panel bellows structure with a diagonal fold between two connecting panels, respectively joined to the end wall and the adjacent front or back wall.

The interior panel of the end wall includes three spaced-apart transverse folds that divide the interior panel into four portions, namely two glue strips (one at each of the top and bottom extremes of the interior panel), a substantially horizontal ledge strip, and a vertical support strip. The ledge strip forms the supporting shoulder or ledge that supports a next-higher container for nested stacking. The ledge is spaced from the rim of the container by the first of the two glue strips. This first glue strip is folded 180° from the outer panel of the end wall, inwardly and downwardly. The first glue strip is attached to the inner surface of the exterior panel adjacent to the top edge fold, to form a reinforcing rail of two-thickness surface-glued stock extending downwardly from the rim at the end wall.

The ledge strip projects a short distance inwardly from the container end wall, namely from the lower edge of the first glue strip, to the second interior panel fold. The distance that the ledge strip projects inwardly can be equal to the outward displacement of the end wall due to its taper, or can be a somewhat greater distance. The vertical support strip projects downwardly from the second interior panel fold at the ledge strip to a third interior panel fold at the bottom of the container. Where the ledge strip projects inwardly by the displacement due to the end wall taper, the third interior panel is disposed immediately adjacent to the fold between the bottom and the exterior end wall panel. Preferably, however, the third interior panel fold is spaced inwardly from the fold between the bottom and the exterior end wall panel. The second glue strip is joined to the third interior panel fold and is glued to the inner surface of the bottom. In an exemplary embodiment apt for bread loaves, the end walls are about six inches (21 cm) high, tapering outwardly by approximately 5°; the ledge panel is about an inch (2.5 cm) wide and is placed at an elevation of about five inches (12.5 cm) or one inch (2.5 cm) below the rim of the container. Other specific dimensions are also possible.

Each side wall preferably comprises an outer panel and an inner panel, joined to one another along a common transverse fold around 180° that extends the length of the container. This fold can be in a common horizontal plane with the rim as defined by the end walls or can be lower, thus defining a cutout at one or both of the front and back walls. The common transverse fold at the upper rim of each side wall alternatively can be two closely spaced 90° folds, thereby having a width equal to the space between the closely spaced folds. That space can provide a gap between the outer and inner front or back wall panels sized to receive the wings extending from the adjacent edges of the end walls or sized to receive two thicknesses of a bellows fold.

The end walls and side walls are tapered outwardly relative to a position perpendicular to the bottom. Thus the container define the inverted frustum of a four sided pyramid. Vertically adjacent containers can thus be stacked in inter-nested relation to one another, the upper container being supported by the two hollow internal shoulders on the interior end wall panels of the next lower container in the stack. The shoulders hold the bottom of the upper container at a short distance below the rim of the lower container, without tending to crush the contents of the underlying container. For relatively light but bulky contents such as bakery products, the containers can be stacked in this manner over quite a number of nested containers, such as a dozen or more, forming a two meter stack. The containers are nevertheless relative light in weight.

All the permanently affixed joints of the container can be made automatically using a fold-and-glue machine operating on a die cut blank shaped to form the bottom and the outer and inner panels of the end and side walls, integrally contiguous with and radiating from the bottom. The inner end wall panel and the wings or bellows panels radiate from the three sides of the outer end wall panel that are opposite from the bottom. The container is formed into a knocked-down-flat state by application of glue and folding along pre-creased lines to join the inner and outer end wall panels along a limited glue strip adjacent to the rim of the container, and to join the extreme end of the inner end wall panel to the bottom.

BRIEF DESCRIPTION OF THE DRAWINGS

These and other features and advantages of the invention will be more fully disclosed in or rendered apparent from the following detailed description of certain preferred embodiments of the invention, to be considered together with the accompanying drawings, wherein like numbers refer to like parts. The depictions embodied by the drawings should be considered part of the entire written description of the invention. In the drawings.

DETAILED DESCRIPTION OF THE PREFERRED EMBODIMENTS

Figure 1:
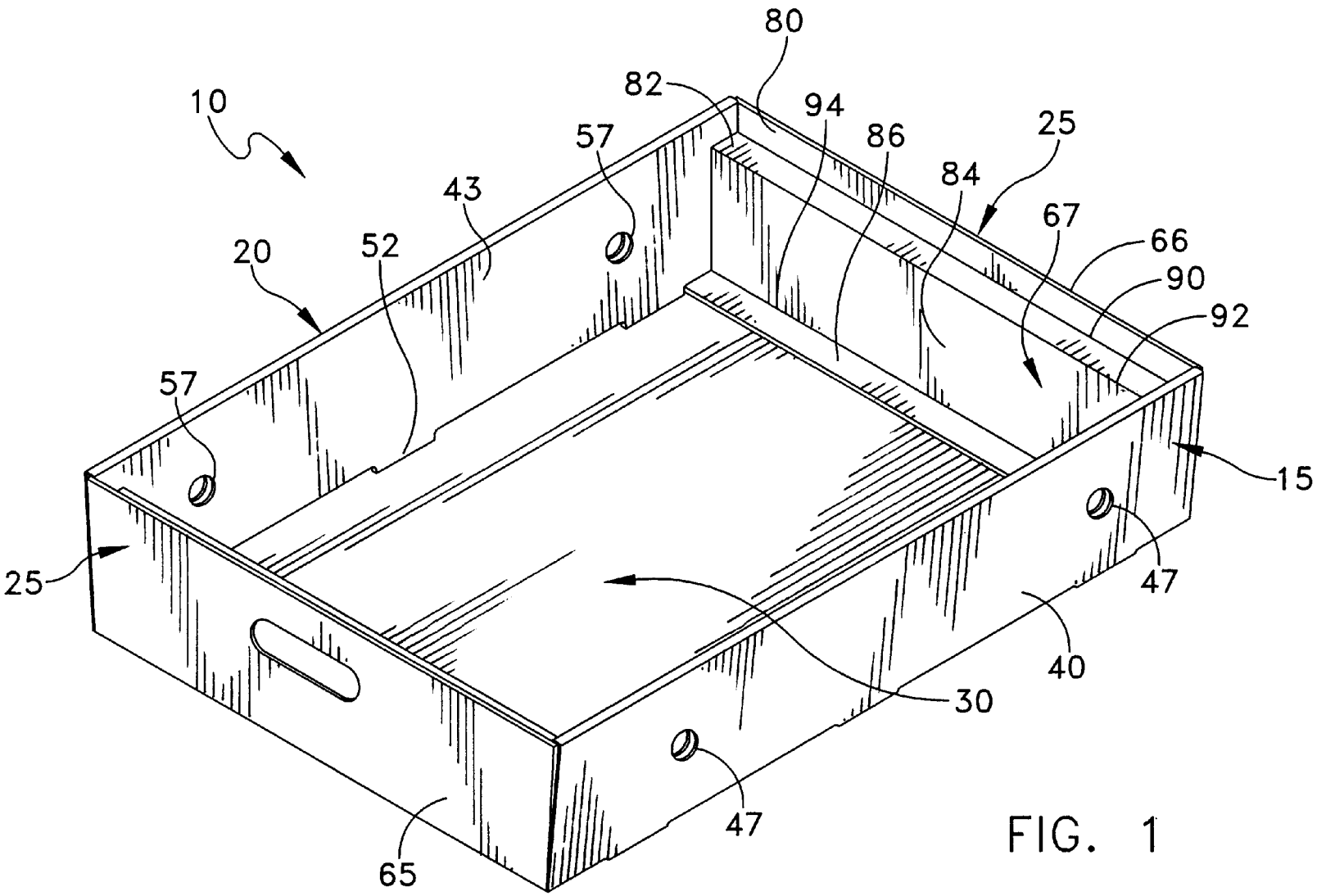
FIG. 1 is a perspective view of a fully erected open-top container according to an embodiment of the invention.
Figure 2:
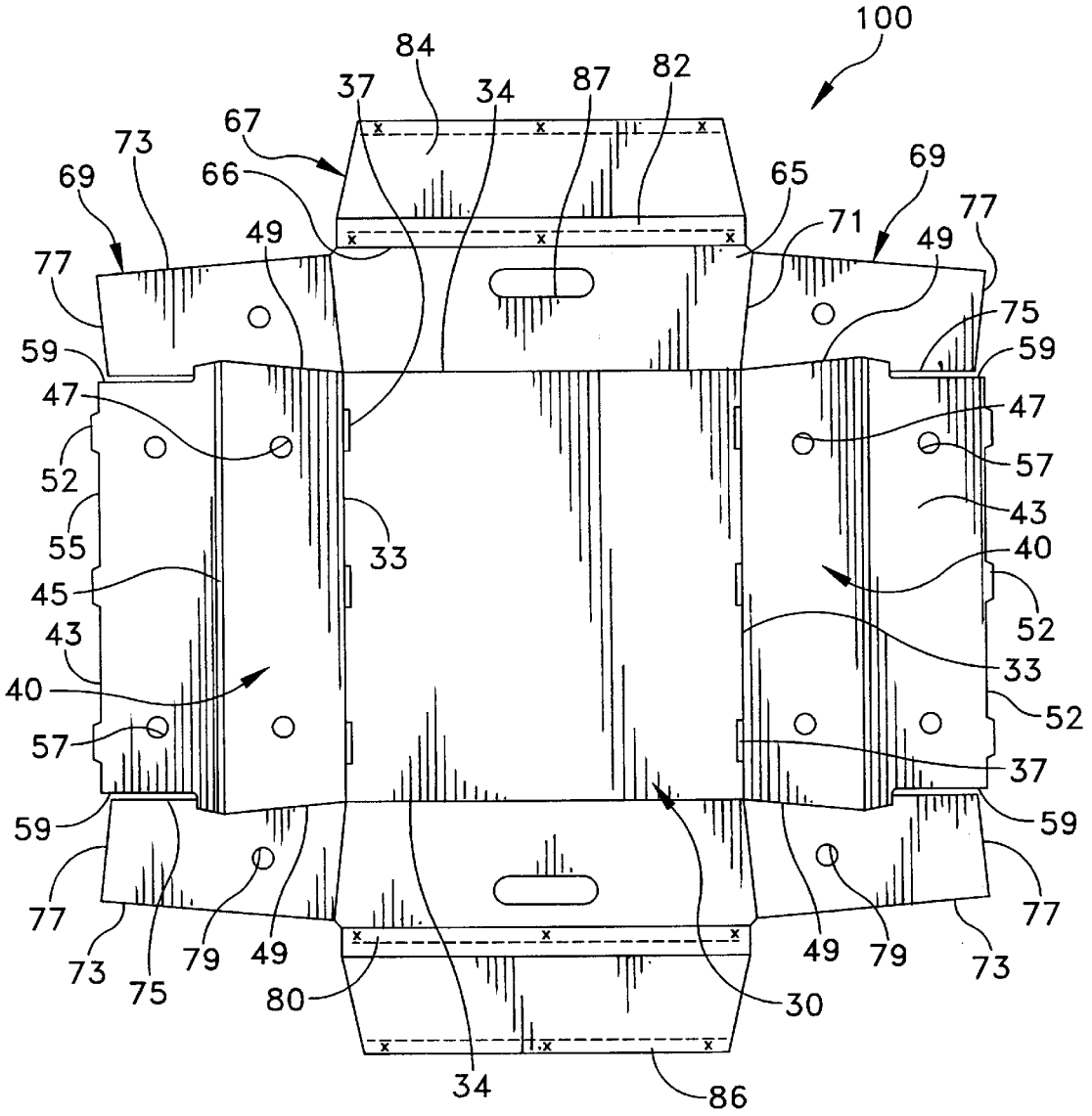
FIG. 2 is a plan view of an integral flat blank prior to being folded, glued, and erected to provide the container shown in FIG. 1.

Referring to FIGS. 1 and 2, a vertically reinforced stackable and self-erecting open-top container 10 is formed by an open-top receptacle having a front wall 15, a back wall 20, and end walls 25, each of which project upwardly and somewhat outwardly from a one piece bottom 30. Accordingly, container 10 is generally shaped as an inverted frust-pyramidal, wider in both length and width at the top rim of container 10 and narrower at bottom 30. Front and back walls 15, 20 and end walls 25 are integral with container bottom 30, and are joined to bottom 30 by respective longitudinally and transversely extending folds 33, 34.

Lines representing fold lines are shown in the drawings by broken and solid lines that represent lines along which the material can be weakened or caused preferentially to fold by any of various means. For example corrugated or other material can be compressed along a thin line defining a fold, or can be cut part way through along the line, or cut all or part way through at spaced intervals, forming preferential fold lines in the KDF blank and/or in the erected container.

As used in this description, terms such as "horizontal," "vertical," "left," "right," "up," "down," "top" and "bottom," etc., used as nouns, adjectives or adverbs (e.g., "horizontally", "rightward", "upwardly", "downwardly", etc.) refer to the orientation of the structure of the invention as it is illustrated in the particular drawing figure when that figure faces the reader. Such terms are not intended to limit the invention to a particular orientation. Similarly, the terms "inwardly" and "outwardly" generally refer to the orientation of a surface or other structure relative to an axis of elongation or axis of rotation, as appropriate. The terms "connected" and "interconnected," when describing the relationship between two or more structures, means that such structures are secured or attached either directly or indirectly through intervening structures and include movable connections such as pivoting connections. The term "operatively" means that the foregoing direct or indirect connections between such structures allow the structures to operate as described and intended by virtue of such connection.

Referring again to FIGS. 1 and 2, in the embodiment shown, front wall 15 and back wall 20 are coextensive, as are end walls 25, each extending from bottom 30 to define a common plane at the top edge or rim of the container. Thus the walls of open-top container 10 abut or are connected at their respective ends, thus forming a rectilinear shape with four closed corners. Bottom 30 comprises a generally rectilinear shape, and can have a plurality of panel locking slots 37 spaced linearly from one another around a perimeter adjacent to longitudinal folds 33. These locking slots can engage the inwardly folded portions of front wall 15 and back wall 20, as discussed further below.

Figure 5:
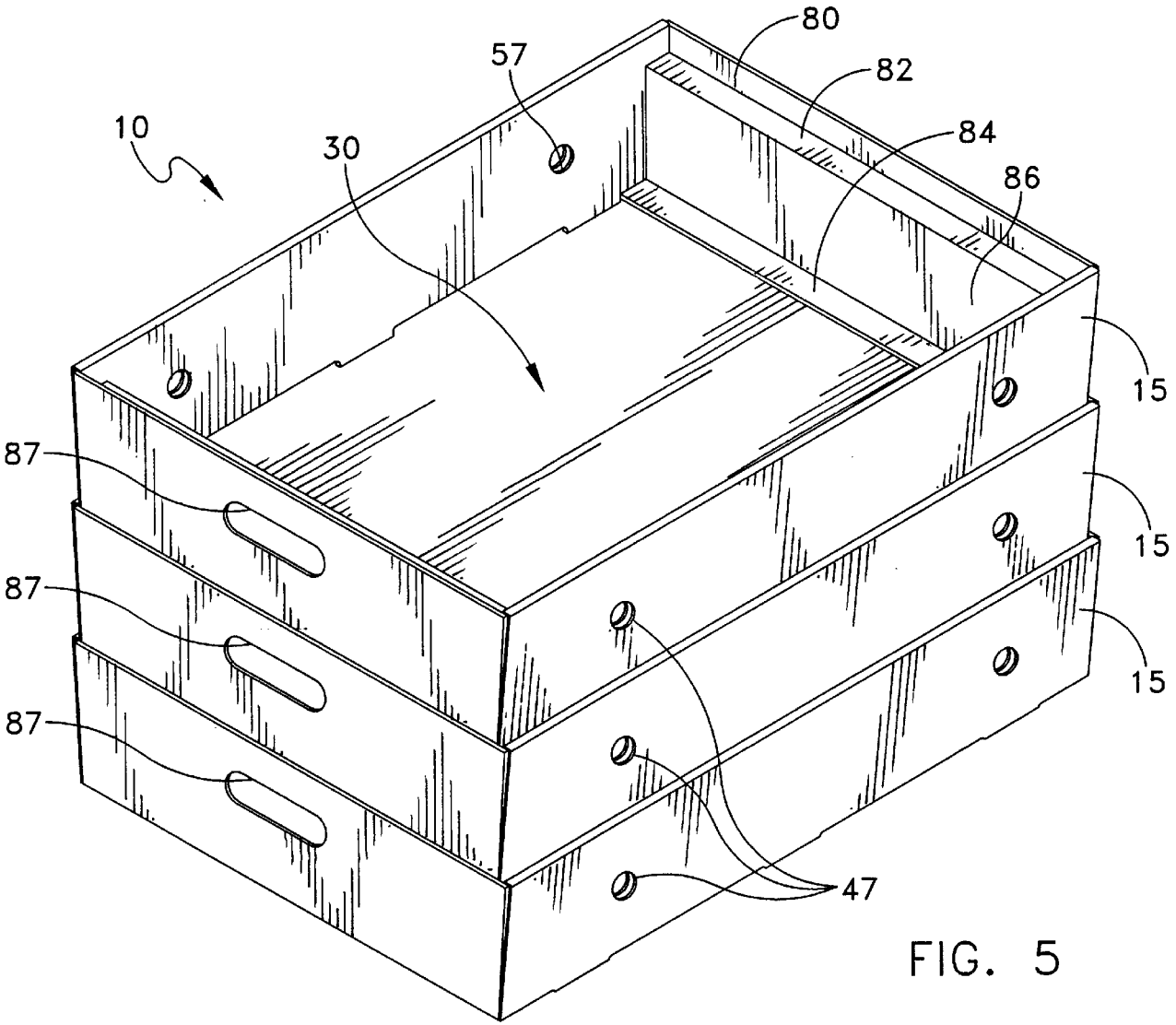
FIG. 5 is a perspective view of a stacked and internested set of open-top container according to an embodiment of the invention.

Bottom 30 is smaller in area than the area defined by the perimeter of the open end or rim of open-top container 10, demarcated by longitudinally and transversely extending folds 33, 34. When upright, container 10 can be described as an inverted frust-pyramidal vessel or tray. Whereas the bottom of the container 10 is smaller then the opening defined by the rim, container 10 can be nestingly stacked in a similar container 10 (FIG. 5). According to an aspect of the invention such nested stacking is limited by a ledge extending inwardly from the end panels adjacent to, and slightly below, the rim.

Figure 3:
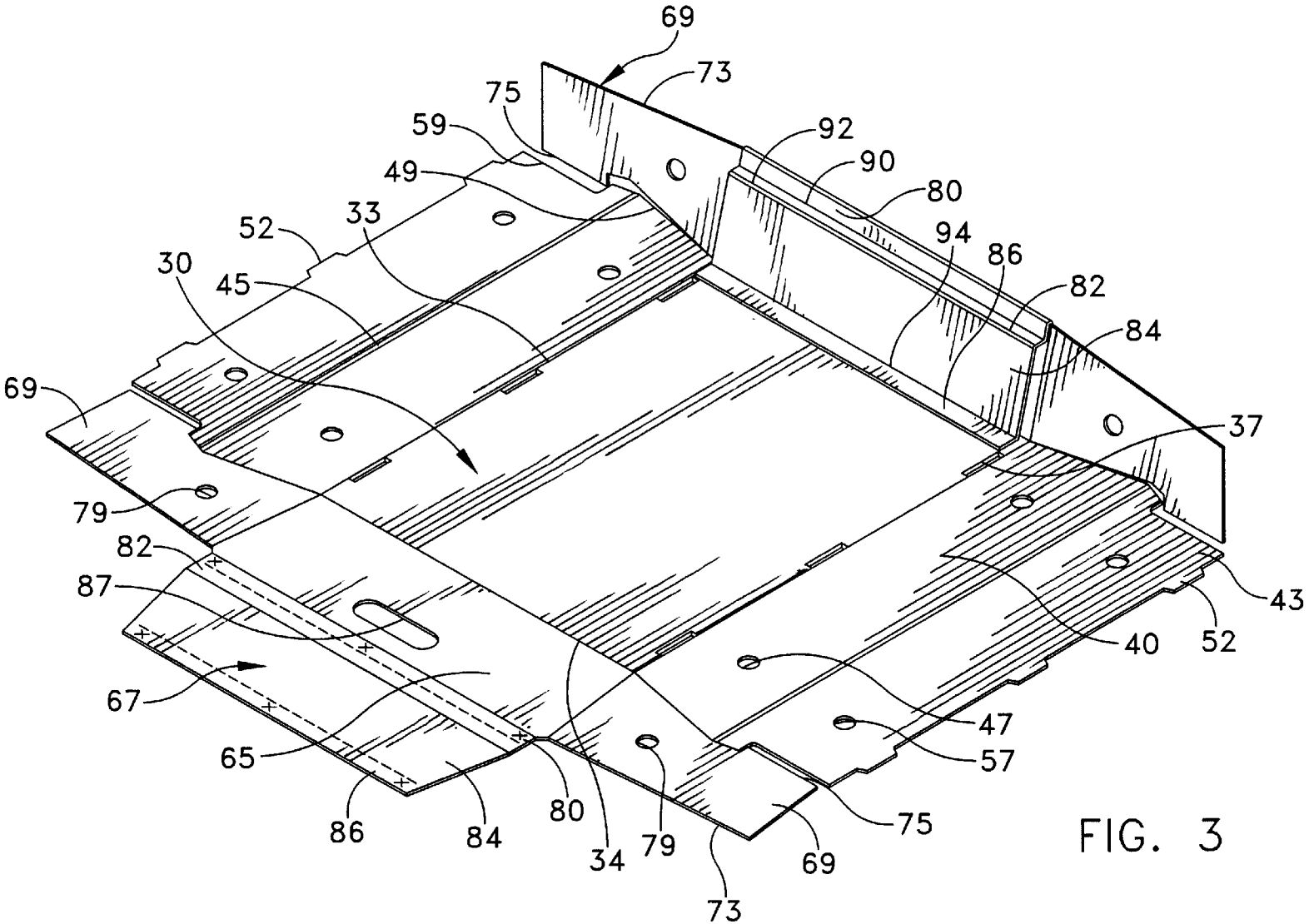
FIG. 3 is a perspective view of a partially glued and erected integral flat blank shown in FIG. 2, showing the gluing and folding operations associated with the hollow internal shoulders to be formed when erecting the end wall.
Figure 4:
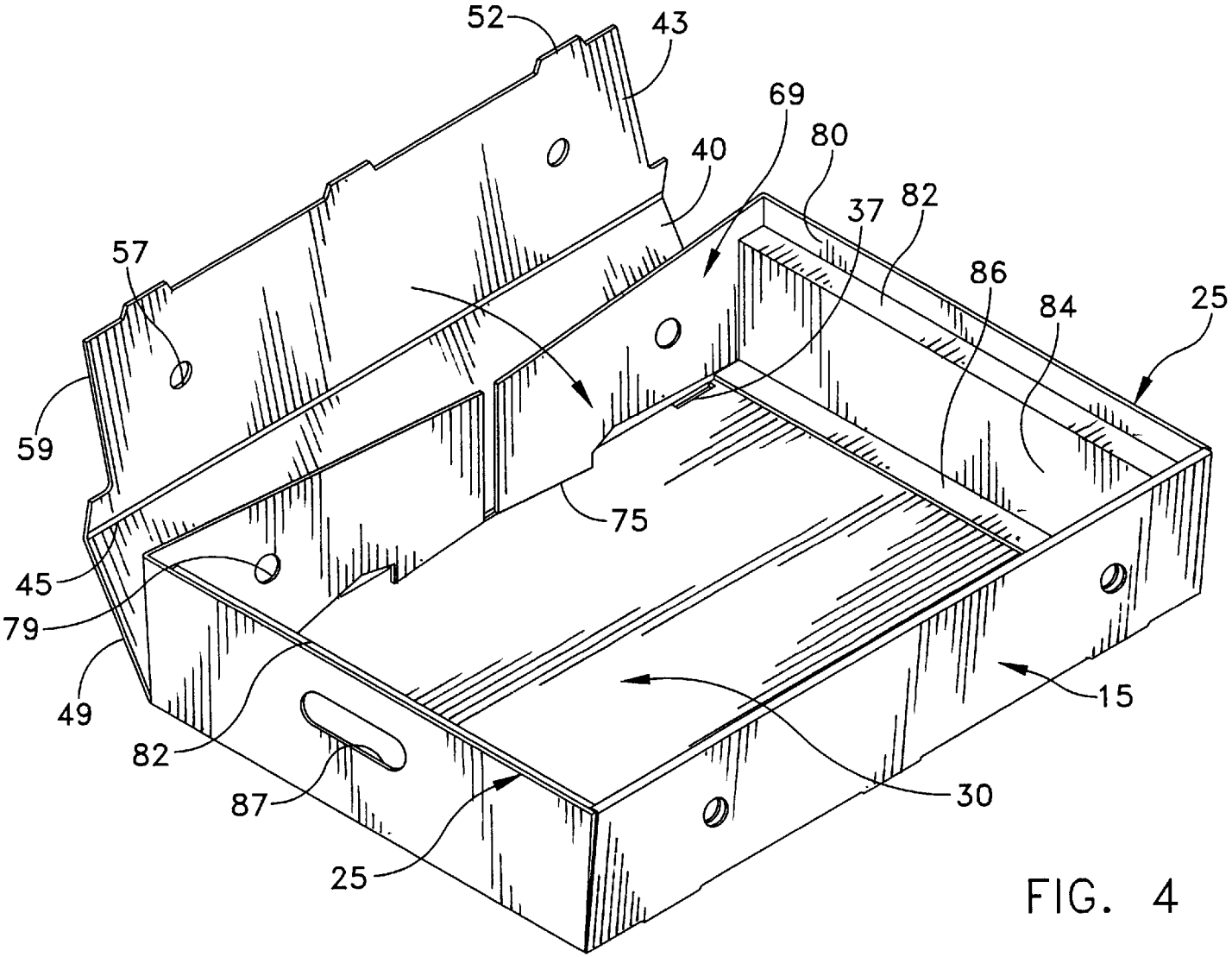
FIG. 4 is a perspective view of a partially erected open-top container according to the invention, showing the folding operations associated with the positioning of the wings within the side wall panels.

Referring to FIGS. 2, 3, and 4, front wall 15 and back wall 20 each comprise an outer panel 40 and an inner panel 43 that are separated by a longitudinally extending fold 45. Each outer panel 40 comprises a single thickness of material, and is joined to bottom 30 along a common longitudinally oriented edge defined by fold 33. One or more vent openings 47 can be placed adjacent to tapered lateral edges 49 in outer panel 40. In this embodiment, each inner panel 43 is folded inwardly and downwardly by 180° relative to its adjacent outer panel 40 and comprises three spaced locking tabs 52 that project outwardly from a longitudinally oriented free edge 55 of inner panel 43 to engage in the locking tab slots 37. A pair of spaced vent openings 57 are positioned adjacent to substantially parallel lateral edges 59 and in corresponding relation to vent openings 47. The distance between lateral edges 59 of inner panel 43 can be less than the distance between tapered lateral edges 49 of outer panel 40 (at their widest portion) so as to provide clearance for a hollow shoulder that forms a portion of each end wall 25. Alternatively, the lateral edges 59 can be shaped and dimensioned to closely complement and thus support the hollow shoulders.

Each end wall 25 includes an exterior panel 65 and a hollow interior shoulder panel 67. The exterior panel 65 comprises a single thickness of material joined to bottom 30 along common transverse fold 34, and is joined to hollow interior shoulder panel 67 along a common transverse fold 66 that turns 180° relative to exterior panel 65, thereby placing interior panel 67 and exterior panel 65 in full surface contact adjacent to, and along, the rim of container 10. An elongate wing 69 is joined to each side edge of each exterior panel 65 along a fold 71. Wings 69 comprise elongate tapered edges 73, a support tab 75, and a free edge 77. An opening 79 is defined through each wing 69 at a position that corresponds to openings 47, 57 in outer panel 40 and inner panel 43 when open-top container 10 is fully erected, as will hereinafter be disclosed in further detail.

Hollow interior shoulder panel 67 comprises three transverse folds that subdivide panel 67 into four integral planar strips. More particularly, hollow interior shoulder panel 67 comprises a top glue strip 80, a ledge strip 82, a vertical support strip 84 and a bottom glue strip 86. Top glue strip 80 is glued to the inner surface of exterior panel 65 adjacent to transverse fold 66, namely along the rim of the container. Preferably, fold 66 is "tight" enough, and glue is spread between top glue strip 80 and exterior panel 65, to cause the inner surface of top glue strip 80 to be securely attached adhesively across their contacting surfaces. The double glued thickness at the rim, namely defined by top glue strip 80 and the attached portion of exterior panel 65, form a reinforced or stiffened rail along the rim at the end walls. The portions of hollow interior shoulder panel 67 to which glue is applied are generally shown in the FIG. 2, by "XXX" patterns. Exposed glue areas are shown in the drawings by solid line "XXX" patterns, whereas concealed or covered areas containing glue (i.e., on a rear face) are shown in broken line "XXX" patterns.

Ledge strip 82 projects outwardly from a first interior panel fold 90 to a second interior panel fold 92, where vertical support strip 84 projects downwardly from second interior panel fold 92 to a third interior panel fold 94 to bottom glue strip 86. Vertical support strip 84 is spaced inwardly from the inner surface of exterior panel 65, thus defining a hollow internal space. A hand grip opening 87 is provided in exterior panel 65 below top glue strip 80, which forms the reinforcing rail along the rim. When a user grasps the container by inserting his or her fingers into hand grip opening 87, such fingers reside under the horizontal ledge strip 82 of hollow interior should panel 67, namely adjacent to the glued-together top glue strip 80 and its attachment to the exterior panel 65. This structure provides the user with a comfortable yet very secure grip on container 10 when lifting or manually carrying the container.

Second interior panel fold 92 is inversely oriented, or biased, relative to first interior panel fold 90. As a consequence, when open-top container 10 is erected from its knock-down-flat (KDF) configuration, ledge strip 82 is pivoted away from exterior panel 65 around fold 90 immediately below top glue strip 80 and the rail adjacent to the rim of the container. As ledge strip 82 rotates about first interior panel fold 90, vertical support strip 84 tends to move away from exterior panel 65, as it rotates about second interior panel fold 92. Third interior panel fold 94 has the same orientation, or bias as first interior panel fold 90, and functions in a similar manner to first interior panel fold 90 rotated when container 10 is erected.

Bottom glue strip 86 preferably projects inwardly from third interior panel fold 94, toward the center of bottom 30, and is glued to the inner surface of bottom 30 (bottom glue strip 86 could also project outwardly from fold 94 instead). In one embodiment of the invention, top glue strip 80, ledge strip 82, and bottom glue strip 86 are each about 1 to 2 inches in width (2.5 to 5 cm), as measured between first and second interior panel folds 90, 92, with vertical support strip 84 being about 4.5 to 5.5 inches in width (11–14 cm), as measured between second and third interior panel folds 92, 94.

The panels forming container 10 are cut, preferably from a single integral flat blank, then glued and folded. The integral flat blank 100 that forms the KDF and erected container is shown in FIG. 2. Blank 100 is processed, by folding and gluing operations, to provide the KDF structure that can be provided to a packer in a compact collapsed arrangement, for example in stacks or bales wherein all the containers are completely flattened as compared to their erected states. Container blank 100 can be integrally cut, for example, from a sheet of corrugated board, paperboard or other sheet material. A number of thicknesses can be die cut in a single step. However, container blanks 100 preferably are cut out individually so that the blank can be scored or compressed along lines that are to be folded, at the same time that the perimeter of the blank is cut from the sheet. The blank is folded along certain lines when it is formed into a collapsed state for shipment, and other lines are folded or partially unfolded when the collapsed blank is erected for packing.

When forming open-top container 10 as shown from a flat corrugated craft board or similar material that has distinct load-bearing aspects in mutually perpendicular directions, it is preferred to orient the board so that the best load-bearing direction is substantially parallel to front and back walls 15, 20. Thus for corrugated board, the flutes of the corrugation run longitudinally in FIG. 1, from one end wall to the other. In this manner the corrugations extend substantially in a vertical direction at vertical supporting strip 84 under ledge strip 82.

Open-top container 10 is erected from its KDF state after top and bottom glue strips 80, 86 of hollow interior shoulder panel 67 are glued to the inner surfaces of exterior panel 65 and bottom 30, as discussed above. When exterior panel 65 is rotated inwardly about transverse fold 34, vertical support strip 84 is caused to move away from the inner surface of exterior panel 65 by (i) the inverse orientation of second interior panel fold 92 relative to first interior panel fold 90 and third interior panel fold 94, and (ii) the fixation of top glue strip 80 and bottom glue strip 86. In this way, an expandable parallelogram structure is created with its four sides formed by ledge 82, vertical support strip 84, the portion of bottom 30 disposed between third interior panel fold 94 and transverse fold 34, and the portion of exterior panel 65 disposed between transverse fold 34 and first interior panel fold 90. This parallelogram structure is wholly flattened in the KDF state, and, when the container is erected by rotating exterior panel 65 upwardly, causes ledge 82 to be positioned substantially horizontally, i.e., in approximately ninety-degree relation to exterior panel 65. Vertical support strip 84 likewise is positioned substantially vertically in spaced relation from exterior panel 65, when the corresponding end wall 25 is rotated into its final position in open-top container 10.

The orientation of exterior panel 65 and interior vertical support strip 84 are described as "substantially" vertical. More particularly, at least exterior panel 65 is tilted outwardly slightly from vertical, for example about five to six degrees, to permit the containers to nest when stacked (FIG. 5). Interior vertical support strip 84 can be parallel to exterior panel 65, and thus also tilted slightly outwardly, but preferably is folded and glued in position such that when the container is erected vertical support strip 84 is precisely vertical or at least more nearly vertical than exterior panel 65. For corrugated material, the flutes are oriented vertically, and in any event the vertical orientation of vertical support panel 84 maximizes the vertical compression force that the container can bear when disposed in a stack under other similar containers nested above.

When erecting container 10, each end wall 25 is rotated inwardly, about transverse fold 34, and each wing 69 is also rotated inwardly about fold 71 until it is oriented in substantially perpendicular relation to exterior panel 65. In this position and in the embodiment shown, each support tab 75 protruding downwardly from wing 69 is positioned in contacting engagement with longitudinal fold 33. To erect front wall 15 and back wall 20, inner panels 43 of front wall 15 and back wall 20 are each folded downwardly and inwardly by 180° relative to outer panels 40, about longitudinal folds 45 and 33, respectively. Preferably, fold 45 is wide enough to admit wing 69 between inner and outer panels 40, 43, namely one thickness of material in this embodiment. Thus, inner panel 43 rotates inwardly by 90° about longitudinal fold 45, and downwardly by 90° about longitudinal fold 33. This folding operation causes locking tabs 52 of inner panel 43 to be oriented downwardly, toward correspondingly positioned panel locking slots 37 in bottom 30, which lock inner panel 43 in its folded position. Wings 69 are then trapped between outer panel 40 and inner panel 43, with openings 47, 57 and 79 aligned with one another to form an opening into container 10. Assembly of open-top container 10 is completed when locking tabs 52 of inner panel 43 have been inserted and engaged by locking slots 37 in bottom 30.

The combination of an outer panel 40, wing 69, and inner panel 43, forming front wall 15 and back wall 20, provides both vertical strength and structural rigidity to open-top container 10 and resistance to lateral deformation. This is in part because front wall 15 and back wall 20 comprise multiple folded thicknesses of material and in part because the spaced end wall exterior and interior panels 65, 67 fit between front wall 15 and back wall 20 and maintain a frusto-pyramidal shape by the outwardly tilted orientation of front wall 15 and back wall 20 and between the end walls 25.

According to an inventive aspect, front and back walls 15, 20 and end walls 25 can each be oriented at about a three degree to ten degree outwardly sloping angle relative to perpendicular (i.e., at an obtuse angle of 93° to 100° relative to bottom 30). Preferably the walls container 10 are oriented at about a six degree outwardly sloping angle relative to vertical (96° relative to bottom 30).

Referring to FIG. 5, a plurality of containers 10 may be stacked one upon another by simply placing end walls 25 of an upper container in alignment with the corresponding end walls 25 of a lower container 10, and setting one container in the other. Whereas the opening around the rim of containers 10 is slightly larger than the dimensions of bottom 30, the upper container is received in the lower container. However, this nesting is limited to the width of top glue strip 80, because the bottom edge of each end wall 25 (defined by transverse fold 34) abuts against at least a portion of ledge 82 of hollow interior shoulder panel 67. As a result, a plurality of containers 10 may be nested together in stacked relation to one another, with the end wall edges defined by transverse folds 34 seated upon a corresponding portion of ledge strips 82 of each hollow interior shoulder panel 67 of the underlying container, and the contents of each container residing below the level of ledge 82 are protected against any vertical compressive force.

Figure 6:
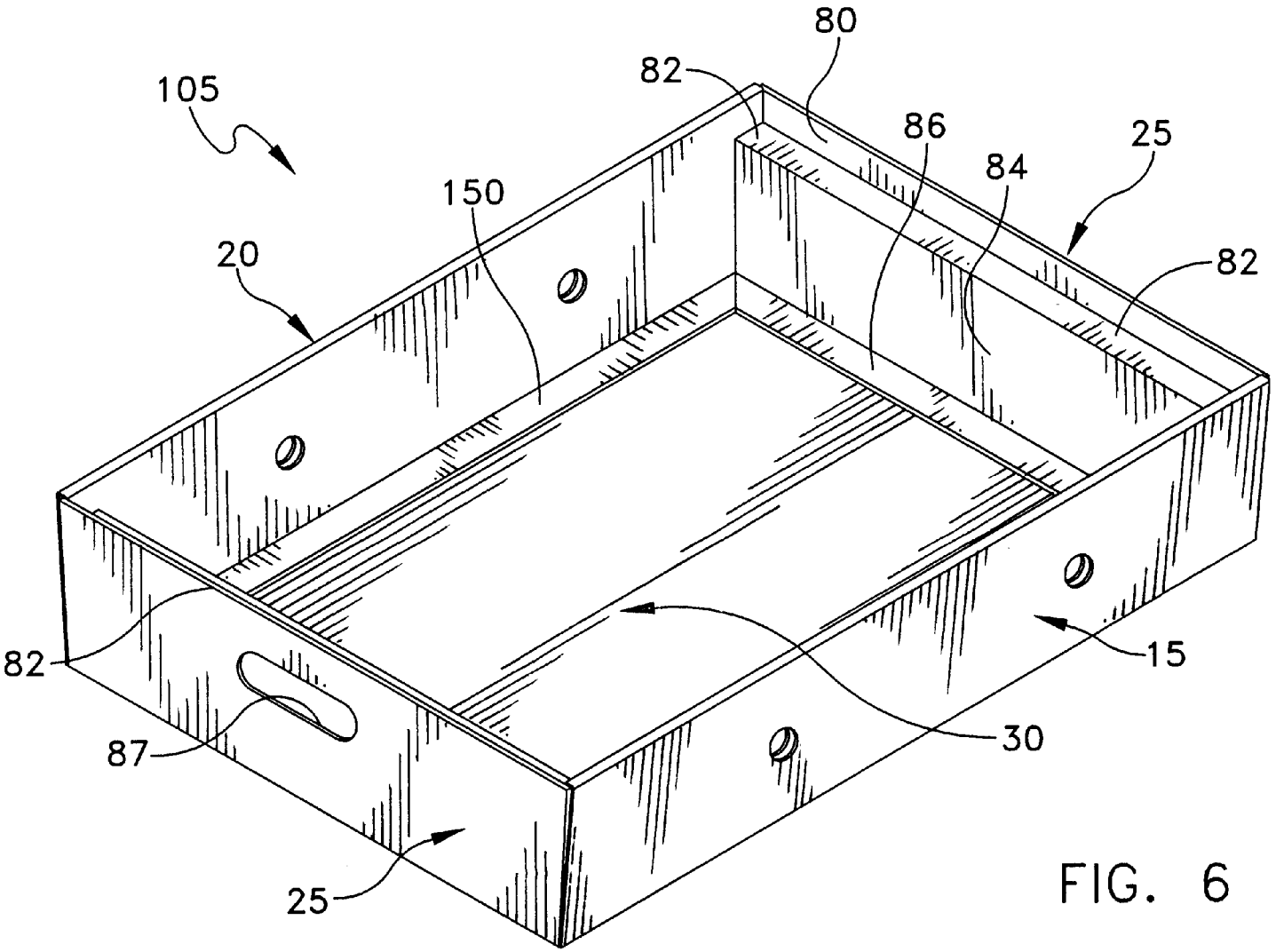
FIG. 6 is a perspective view illustrating an alternative embodiment of the invention.
Figure 7:
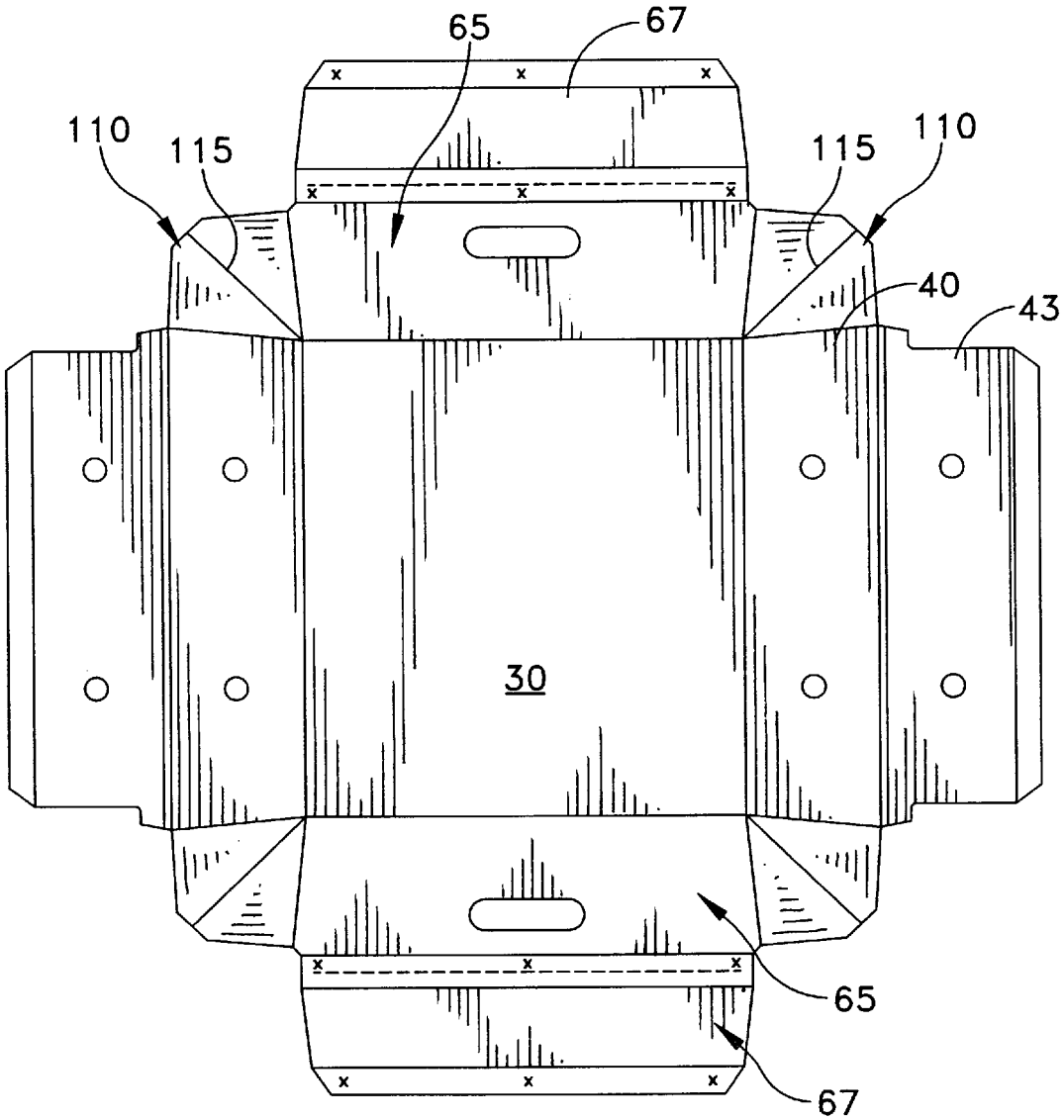
FIG. 7 is an elevational view of flat blank of the alternative embodiments shown in FIG. 6, with a bellows fold provided between the inner panels of the front and back wall and their adjacent end walls.
Figure 8:
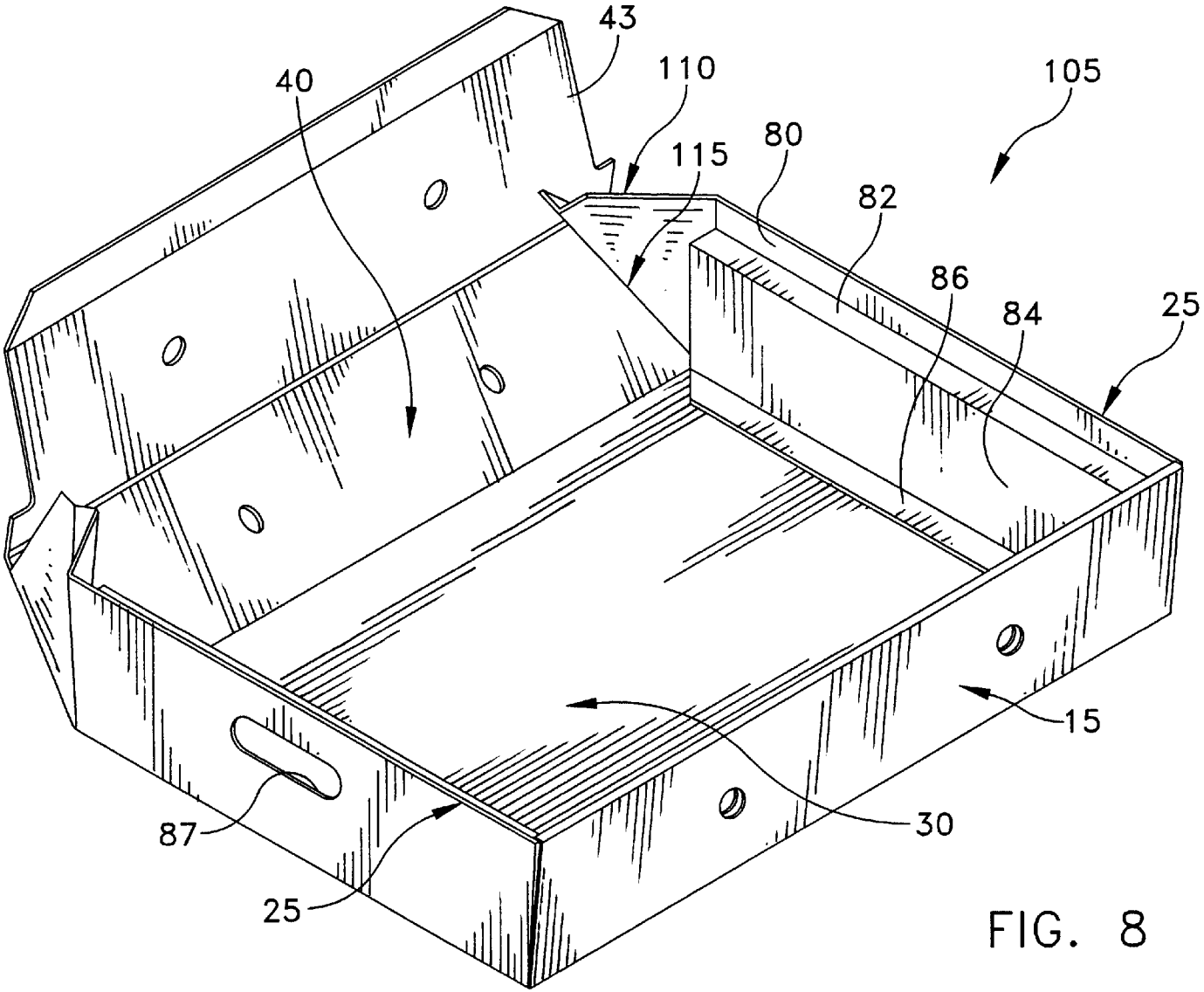
FIGS. 8 and 9 are perspective views of a partially erected container showing the bellows folds being captured between the inner and outer panels of the front and back walls, respectively, in lieu of wings extending laterally from the inner panel of the end walls as in the previous embodiments.
Figure 9:
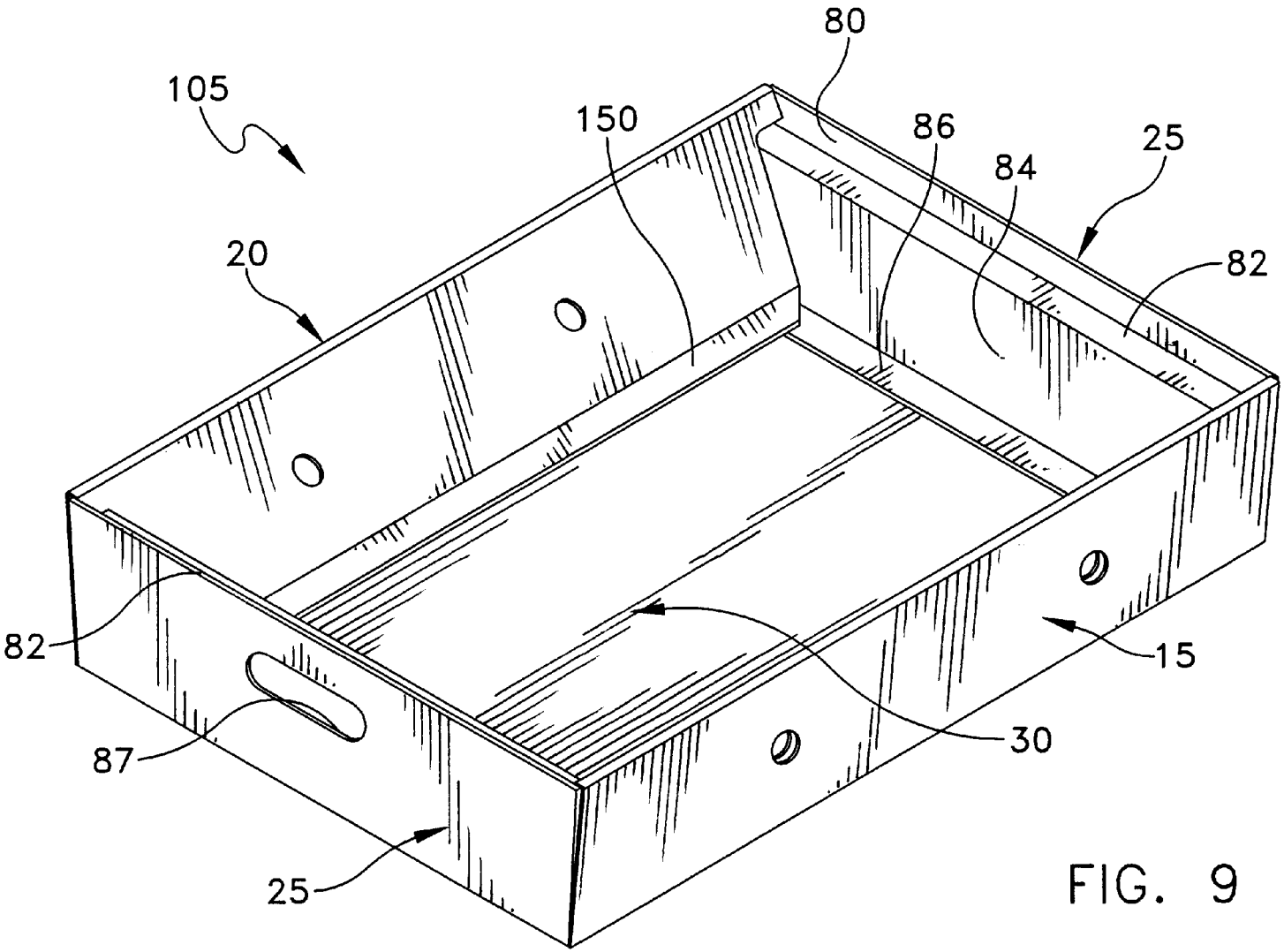

FIGS. 6–8 illustrate several exemplary ways in which the container can be varied in keeping with the invention. In FIGS. 6, 7 and 8 for example, in container 105, a bellows fold 110 is provided between outer panels 110 of the front and back wall 15,20 and their adjacent end walls 25, bellows folds 110 being captured between the outer and inner panels 40,43 of front and back walls 15,20, respectively, in lieu of wings 69 extending laterally from exterior panel 65 of end walls 25 as in container 10. Bellows fold 110 is provided by including a web extending between exterior panel 65 of end walls 25 and each adjacent side wall in the integrally cut-out flat blank. The web is subdivided by a 180° fold along line 115 oriented diagonally relative to the associated corner of bottom 30. Bellows fold 110 is flattened between inner and outer panels 40,43 of front or back wall 15,20 thus forming a 90° angle between end walls 25 and an adjacent portion of the web, and 180° angles along the diagonal fold as well as between the front (or back) wall and the adjacent portion of the web. The two folded-together portions of the flattened bellows fold are captured between inner and outer panels 40,43 of front (or back) wall 15,20 in the same manner that wing 69 is captured in container 10. However, in FIG. 6, captured bellows fold 110 is two thicknesses of material as folded, whereas wing 69 is only one thickness.

Figure 10:
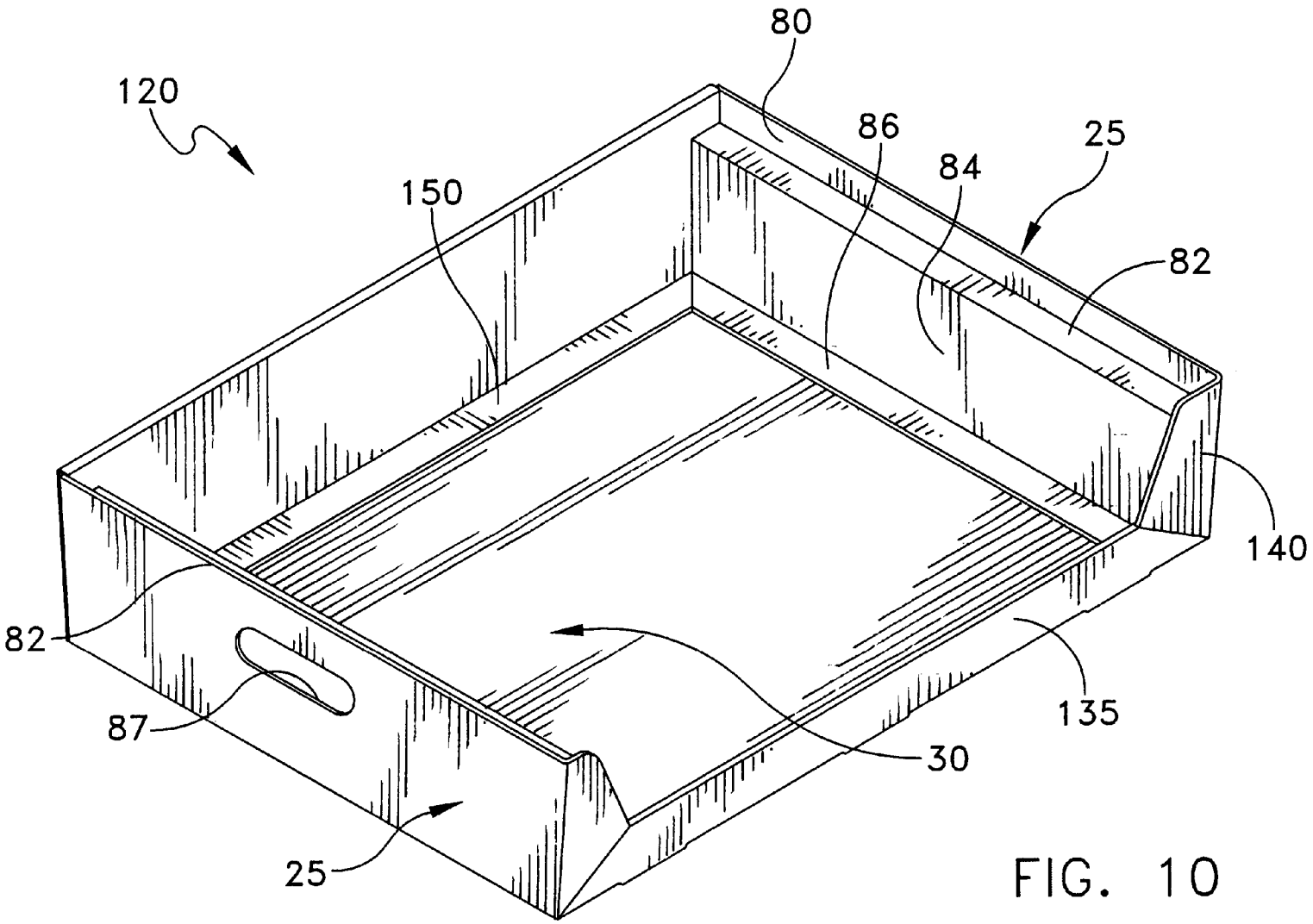
FIG. 10 is a perspective view of another alternative embodiment in which one of the front and back walls is lower in elevation than the end walls over a span between the end walls, thereby providing a cutout for access to the contents of the container when stacked.
Figure 11:
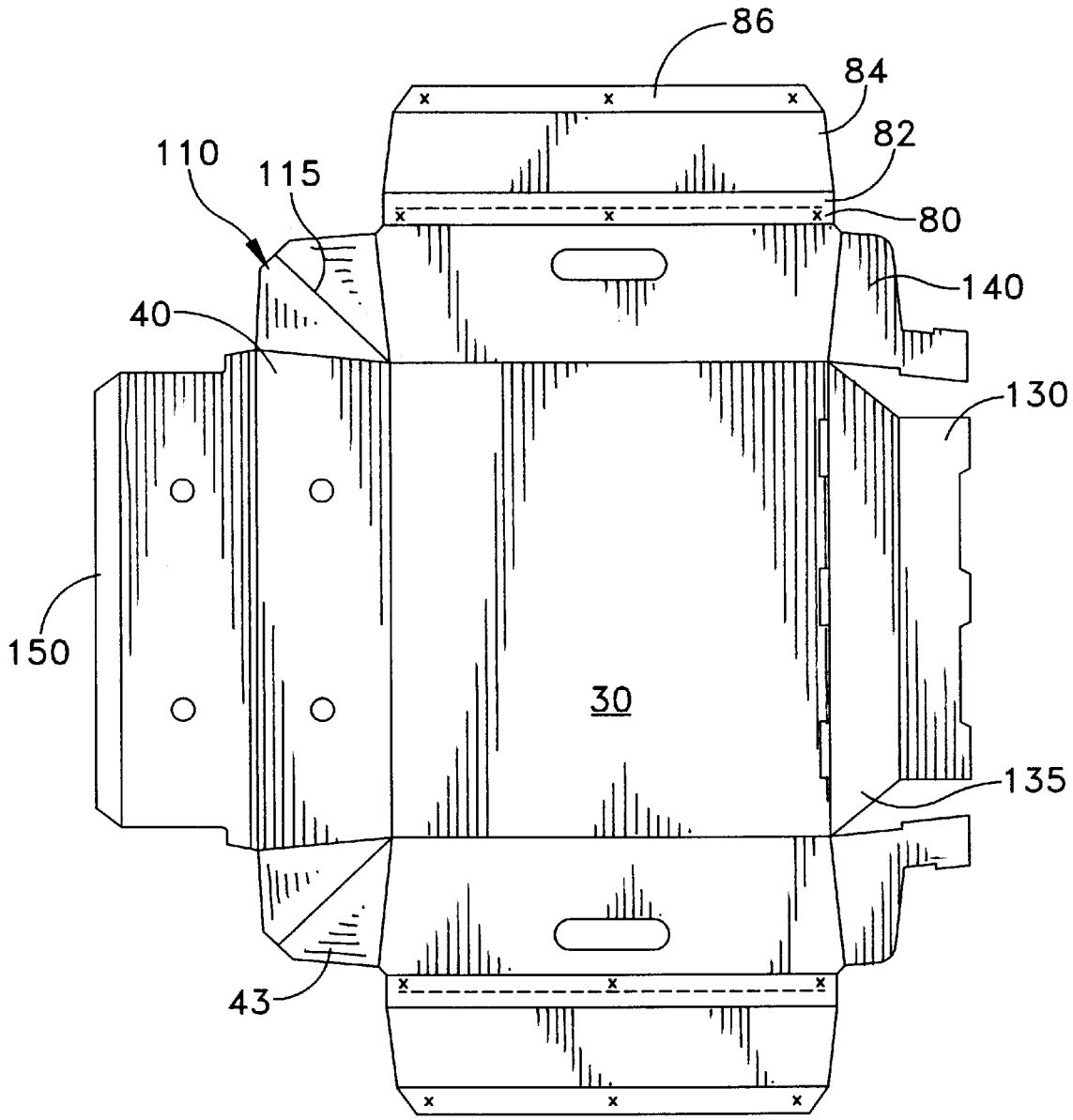
FIG. 11 is a plan view of an integral flat blank prior to being folded, glued, and erected to provide the container shown in FIG. 10.

FIGS. 10–13 illustrate two alternative embodiments, containers 120 and 125, in which one or both of the front and back walls is made lower in elevation than the Adjacent end walls over a limited span, spaced inwardly from end walls 25, thereby providing a cutout for access to the contents of the container when stacked. This is accomplished by placing the fold between inner panel 130 and outer panel 135 of front and/or back walls 25 nearer to bottom 30 and reducing the vertical dimension of each of such inner and outer panels. In FIG. 10 the cutout is only in one of the front or back and in FIG. 12 a cutout is provided in both the front and the back walls. In these embodiments either a wing 140 extending laterally from the outer panel of the end wall, or a bellows fold 110 between the outer panels of the end and front (or back) walls is captured between the folded inner and outer panels of the front and/or rear walls. However, the vertical dimension of the wing or bellows fold is correspondingly reduced so as to be captured between the inner and outer panels of the front and/or rear walls below the cutout.

Figure 12:
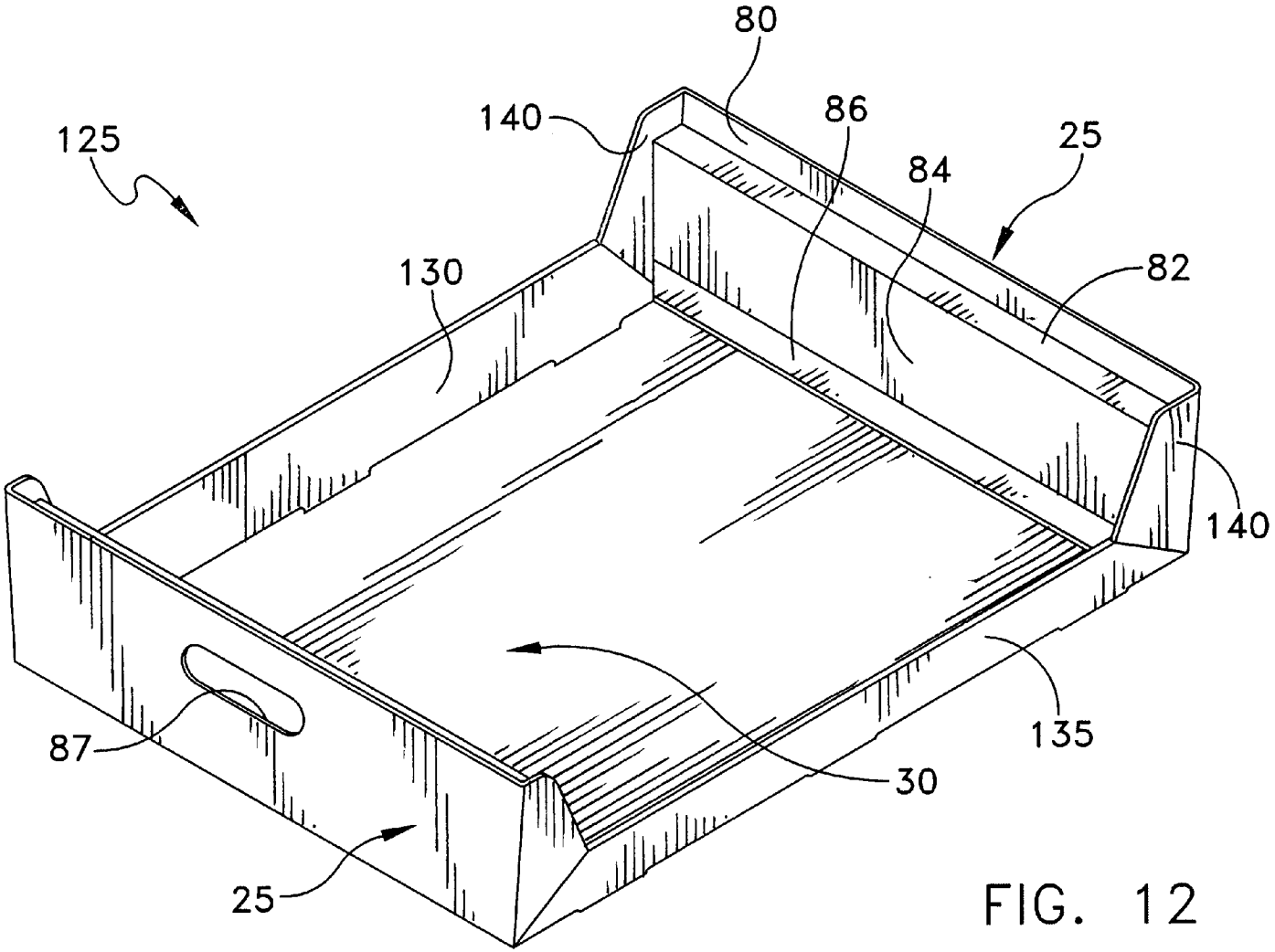
FIG. 12 is a perspective view of a further alternative embodiment corresponding to FIG. 12, having a cutout in both the front and back walls.
Figure 13:
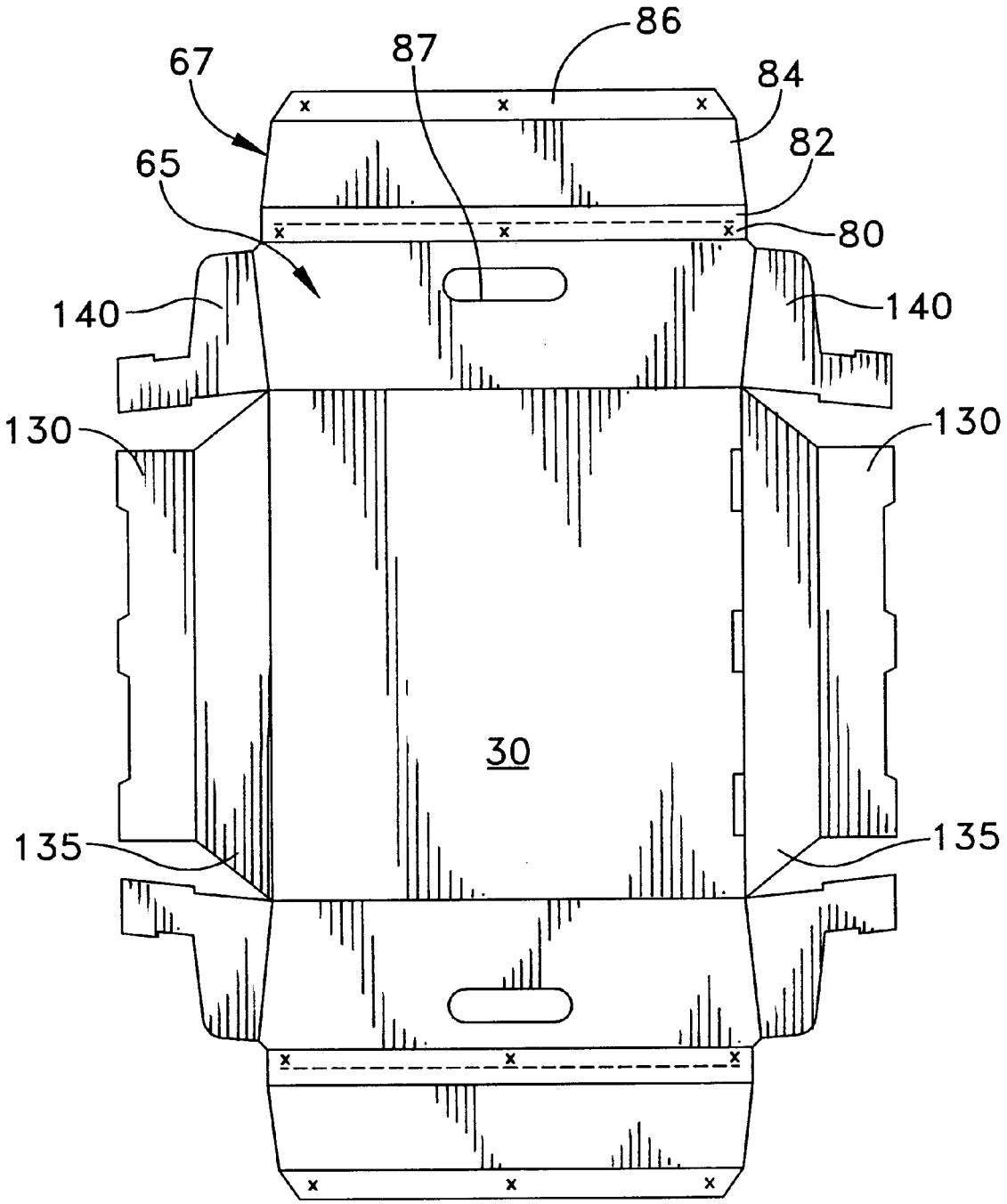
FIG. 13 is a plan view of an integral flat blank prior to being folded, glued, and erected to provide the container shown in FIG. 12.

As shown in the embodiments of FIGS. 1–6, the inner panel of the front and rear walls can be shaped along its edge facing the adjacent end wall, so as to be complementary with the erected shape of the inner panel of such end wall, including its inwardly protruding ledge. In this manner, the ledge structure and the complementary inner panel of the front (or back) engage one another and provide mutual support. In the embodiments of FIGS. 10 and 12, in which cutouts are provided in the front and/or rear walls, this complementary shaping is not used. In particular, the cutouts in FIGS. 10 and 12 are spaced inwardly from the adjacent end walls to leave a portion of the outer panel of the cutout front or back wall that extends to the full height of the end wall. In other words, the inner panel of the cutout front and/or back wall is laterally shorter than the outer panel thereof.

Other alternative configurations are possible but are not illustrated to avoid overburdening the drawings illustrating the invention. For example, the locking slots in bottom 30 can be omitted, nevertheless retaining the inner panel of the front and rear walls at an inwardly folded position, namely at 180° relative to the outer panel of the same wall. This is accomplished by providing a foot portion 150 (FIGS. 6, 7, 9, 10 and 11) on the inner panel of the front or rear wall, folded 90° so as to extend inwardly from the front or rear wall along bottom 30. Foot portion 150 engages endwise against the bottom glue strip 86 to hold the inner panel of the front or rear wall from rotating away from the outer panel thereof.

As another possibility, the cutouts in the front and/or rear can be wider or narrower than those in the illustrated examples. In addition, hand grip opening 87 in the outer panel of the end walls can be alternatively shaped, or additional similar hand grip openings 87 can be provided, etc. Preferably, however, any hand grip openings 87 are disposed just below the top glue strip 80 of the inner panel of the associated end wall, such that the structural support provided by the doubled over and glued material along the rim of the container at the end wall is of benefit in supporting the container, or a stack of nested containers, when manually held and carried.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. An open-top container formed from a single integral sheet of material comprising:

a bottom, two spaced end walls, two spaced side walls, and two hollow internal shoulders positioned in adjacent supporting relation to each of said end walls, wherein said end walls and said side walls are tapered outwardly relative to said bottom, thereby allowing for the nesting of a plurality of said containers one on top of another supported by said two hollow internal shoulders; wherein each of said end walls includes an exterior panel and an interior panel that are joined to one another along a first fold, said exterior panel being further joined to said bottom along a second fold and including two laterally extending wings that are joined, one each, to the side edges of said exterior panel along a third fold; and, wherein said interior panel includes three spaced-apart folds that divide said interior panel into four strips.

2. An open-top container according to claim 1 wherein said interior panel comprises a top glue strip, a bottom glue strip, a ledge strip, and a vertical support strip wherein said top glue strip is glued to an inner surface of said exterior panel adjacent to said first fold, said ledge strip projects outwardly from a first interior panel fold to a second interior panel fold, said vertical support strip projects downwardly from said second interior panel fold to a third interior panel fold in spaced relation to said exterior panel, and said bottom glue strip is glued to a surface of said bottom, and wherein said ledge strip is disposed substantially flat against an associated end wall in a collapsed configuration of the container and protrudes in an erected configuration of the container.

3. An open-top container according to claim 2 wherein the end wall comprises a rim portion wherein said top glue strip and said exterior panel are glued over abutting surfaces thereof and further comprising a grip opening formed in the exterior panel below the top glue strip and adjacent to said ledge strip, whereby the container can be manually grasped by extending one's fingers into the grip opening and engaging under the ledge strip between said interior and exterior panels of the end wall.

4. An open-top container according to claim 2 wherein said ledge strip projects outwardly from a first interior panel fold to a second interior panel fold, said vertical support strip projects downwardly from said second interior panel fold to a third interior panel fold in spaced-relation to an inner surface of said exterior panel and said lower glue.

5. An open-top container according to claim 4 wherein said second interior panel fold is inversely oriented relative to said first interior panel fold so that when said open-top container is erected, said ledge strip tends to move away from said exterior panel as it rotates about first interior panel fold, and said vertical support strip tends to move away from said exterior panel, as it rotates about said second interior panel fold, with said third interior panel fold having has the same orientation as said first interior panel fold.

6. An open-top container according to claim 1 wherein said two spaced end walls and said two spaced side walls are oriented at about a three degree to ten degree outwardly sloping angle relative to perpendicular to said bottom.

7. An open-top container according to claim 1 wherein said two spaced end walls and said two spaced side walls are oriented at about a six degrees outwardly sloping angle relative to perpendicular to said bottom.

8. An open-top container according to claim 7 wherein said two spaced end walls and said two spaced side walls are integral with said bottom and are joined to said bottom by respective longitudinally and transversely extending folds.

9. An open-top container according to claim 1 wherein said two spaced end walls and said two spaced side walls are oriented relative to said bottom so as to form an inverted substantially frusto-pyramidal container.

10. An open-top container according to claim 1 wherein said open top container comprises an inverted frusto-pyramidal tray when positioned in an upright orientation.

11. An open-top container according to claim 1 wherein said wings comprise tapered lateral edges.

12. An open-top container formed from a single integral sheet of material comprising:

a bottom, two spaced end walls, two spaced side walls, and two hollow internal shoulders positioned in adjacent supporting relation to each of said end walls, wherein said end walls and said side walls are tapered outwardly relative to said bottom, thereby allowing for the nesting of a plurality of said containers one on top of another supported by said two hollow internal shoulders; wherein each of said end walls includes an exterior panel and an interior panel that are joined to one another along a first fold, said exterior panel being further joined to said bottom along a second fold and including two laterally extending wings that are joined, one each, to the side edges of said exterior panel along a third fold; and, wherein each of said side walls includes an outer panel and an inner panel that are joined to one another along a fourth fold that (i) extends the length of said open-top container and (ii) provides a gap between said outer and said inner panels that is sized to receive one of said wings extending from an adjacent edge of said end walls.

13. An open-top container according to claim 12 wherein said outer panel and said inner panel are joined by a longitudinally extending fold and each outer panel comprises a single thickness of material, and is joined to said bottom along a fifth, longitudinally oriented fold.

14. An open-top container according to claim 12 wherein each of said inner panels comprise substantially parallel lateral edges and each of said outer panels comprise tapered lateral edges wherein the distance between said substantially parallel lateral edges of said inner panel is less than the distance between said tapered lateral edges of said outer panel at a widest portion thereof so as to provide clearance for said hollow internal shoulder when said open-top container is erected.

15. An open-top container comprising a bottom, two spaced end walls, two spaced side walls, and two hollow internal shoulders provided on interior panels of the end walls, said shoulders positioned in adjacent supporting relation to each of said end walls, wherein each of said interior panels includes three spaced-apart folds that divide said interior panel into four strips comprising a top glue strip, a bottom glue strip, a ledge strip, and a vertical support strip, wherein said top glue strip is affixed in surface contact with an inner surface of said exterior panel adjacent to said first fold and at a rim of the container over the end walls, wherein said ledge strip projects outwardly from a first interior panel fold to a second interior panel fold, said vertical support strip projects substantially vertically downwardly from said second interior panel fold to a third interior panel fold in spaced relation to said exterior panel, and said bottom glue strip is glued to a surface of said bottom; and, wherein said side walls and said end walls are tapered outwardly relative to said bottom such that a plurality of said containers are nestably stackable one on top of another, an upper said container being supported by said two hollow internal shoulders on a lower said container in a stack.

16. An open-top container according to claim 15 wherein each of said inner panels comprise substantially parallel lateral edges and each of said outer panels comprise tapered lateral edges wherein a distance between said substantially parallel lateral edges of said inner panel is less than a distance between said tapered lateral edges of said outer panel at a relatively wider portion thereof, so as to provide clearance for said hollow internal shoulder when said open-top container is erected.

17. An open-top container according to claim 16 wherein said ledge strip projects outwardly from a first interior panel fold to a second interior panel fold, said vertical support strip projects downwardly from said second interior panel fold to a third interior panel fold in spaced-relation to an inner surface of said exterior panel.

18. An open-top container according to claim 17 wherein said second interior panel fold is folded inversely relative to said first interior panel fold so that when said open-top container is erected, said ledge strip tends to move away from said exterior panel as said ledge strip rotates about first interior panel fold, and said vertical support strip tends to move away from said exterior panel, as said vertical support strip rotates about said second interior panel fold, with said third interior panel fold being oriented in a same direction as said first interior panel fold.

* * * * *